US006267258B1

(12) United States Patent
Wilkerson et al.

(10) Patent No.: US 6,267,258 B1
(45) Date of Patent: Jul. 31, 2001

(54) GRAVITY FEED PULL OUT SHELF WITH REAR STORAGE AREA AND ASSOCIATED METHOD FOR DISPLAYING AND STORING A PRODUCT

(75) Inventors: Craig A. Wilkerson; Phil O. McKinney, both of Lagrange, KY (US)

(73) Assignee: Gilmour, Inc., Newark, DE (US)

( * ) Notice: Subject to any disclaimer, the term of this patent is extended or adjusted under 35 U.S.C. 154(b) by 0 days.

(21) Appl. No.: 09/564,236

(22) Filed: May 4, 2000

Related U.S. Application Data

(60) Provisional application No. 60/133,149, filed on May 7, 1999, provisional application No. 60/133,150, filed on May 7, 1999, and provisional application No. 60/133,151, filed on May 7, 1999.

(51) Int. Cl.[7] ..... A47F 5/00

(52) U.S. Cl. ..... 211/151; 211/90.02; 211/90.03; 211/119.003; 211/175; 211/88.01; 312/118; 312/126

(58) Field of Search ..... 211/175, 59.2, 211/181.1, 151, 90.02, 90.03, 119.003, 88.01, 126.9, 126.15, 133.5; 312/117, 118, 119, 122, 126; 206/730, 735

(56) References Cited

U.S. PATENT DOCUMENTS

| | | | | |
|---|---|---|---|---|
| 1,455,610 | * | 5/1923 | Haskell . | |
| 1,517,537 | * | 12/1924 | Daggett . | |
| 1,748,843 | * | 2/1930 | Kuckel . | |
| 1,975,327 | | 10/1934 | Loney . | |
| 2,145,563 | | 1/1939 | Watson . | |
| 2,852,143 | | 9/1958 | Taber . | |
| 2,928,551 | | 3/1960 | Abrams et al. . | |
| 2,971,655 | * | 2/1961 | Duboff et al. . | |
| 3,399,784 | | 9/1968 | Buchbinder et al. . | |
| 3,643,808 | | 2/1972 | Ryan et al. . | |
| 4,136,783 | | 1/1979 | Karashima . | |
| 4,212,506 | * | 7/1980 | Merl | 312/118 |
| 4,482,066 | | 11/1984 | Dykstra . | |
| 4,687,404 | | 8/1987 | Seiz at al. . | |
| 4,715,765 | | 12/1987 | Agnoff . | |
| 4,771,898 | | 9/1988 | Howard et al. . | |
| 4,776,472 | | 10/1988 | Rosen . | |
| 4,923,070 | | 5/1990 | Jackle et al. . | |
| 5,080,241 | | 1/1992 | Konstant . | |
| 5,096,074 | | 3/1992 | Merl . | |
| 5,115,920 | | 5/1992 | Tipton et al. . | |
| 5,181,623 | * | 1/1993 | Linden et al. | 211/59.2 X |
| 5,197,610 | | 3/1993 | Bustos . | |
| 5,230,554 | * | 7/1993 | Camilleri . | |
| 5,477,970 | * | 12/1995 | Watt et al. | 211/175 |
| 5,480,039 | * | 1/1996 | Merl | 211/88.01 |
| 5,505,315 | | 4/1996 | Carroll . | |
| 5,695,076 | | 12/1997 | Jay . | |
| 5,738,019 | * | 4/1998 | Parker | 211/175 X |
| 5,848,713 | | 12/1998 | Allen . | |

* cited by examiner

*Primary Examiner*—Robert W. Gibson, Jr.
(74) *Attorney, Agent, or Firm*—Maginot, Addison & Moore

(57) ABSTRACT

A retail apparatus for storing and displaying a product includes a base member having a roller surface associated therewith and a rack assembly having a number of rollers rotatably secured thereto. The rack assembly has a product bin and a storage rack. The storage rack is substantially horizontally disposed. The product bin is positioned at an inclined orientation relative to the storage rack. The rollers are positioned in contact with the roller surface so as to allow the rack assembly to roll relative to the base member. A method of storing and displaying a number of products is also disclosed.

17 Claims, 9 Drawing Sheets

GRAVITY FEED PULL OUT SHELF WITH REAR STORAGE AREA AND ASSOCIATED METHOD FOR DISPLAYING AND STORING A PRODUCT

This application claims the benefit of U.S. Provisional Applications Ser. Nos. 60/133,149, 60/133,150, and 60/133,151; each of which was filed on May 7, 1999.

CROSS REFERENCE

Cross reference is made to copending U.S. patent applications Ser. No. 09/564,238, entitled "Automatic Self-Fronting Pallet Assembly and Associated Method for Shipping and Displaying a Product" by Craig A. Wilkerson and Phil McKinney and Ser. No. 09/564,237, entitled "Gravity Feed Flip-Top Box and Associated Method for Shipping and Displaying a Product" by Craig A. Wilkerson and Phil McKinney, both of which are assigned to the same assignee as the present invention, and both of which are filed concurrently herewith.

TECHNICAL FIELD OF THE INVENTION

The present invention relates generally to product containers, and more particularly to a gravity feed pull out shelf with rear storage area and associated method for displaying and storing a product.

BACKGROUND OF THE INVENTION

Products such as lawn and garden products are typically produced at a manufacturing facility and thereafter shipped to a retail store such as a hardware store or the like in order to be sold to customers. Historically, such products have been packaged, shipped, and displayed to customers in numerous different manners. For example, relatively large or irregular shaped products such as garden hoses have been vertically stacked on flat wooden pallets or skids for shipment to the retail store and subsequent display. In particular, coiled sections of garden hose have heretofore been vertically stacked on a flat pallet, bundled in shrink wrap or the like, and shipped to a retail store. Once received at the retail store, the pallet is positioned in a display location such as under a retail shelf. Thereafter, the shrink wrap is removed in order to allow customers to select sections of the garden hose for purchase during a visit to the store.

However, such prior art shipping and displaying arrangements have a number of drawbacks associated therewith. For example, by vertically stacking the sections of garden hose on the pallet, the labels affixed to the hoses face directly upwardly thereby potentially rendering the labels difficult to see by the customer. Moreover, as indicated above, the pallet containing the vertically stacked sections of garden hose is typically positioned in the retail store at a location under a retail shelf. When the sections of garden hose near the front of the pallet are sold or otherwise removed from the pallet, the retailer must invest labor to "front" or otherwise pull the remaining sections of garden hose located at the rear of the pallet forward thereby increasing the retailer's direct labor costs. Alternatively, the retailer may opt to not front the remaining hose sections thereby potentially allowing the hose sections to go unnoticed by customers, or alternatively, potentially creating a situation in which the customer injures himself or herself by, for example, striking his or her head on the retail shelf under which the pallet is located.

On the other hand, relatively small products such as garden sprinklers and spray nozzles have heretofore been placed in cardboard shipping cartons for shipment to the retail store. In particular, the sprinklers or spray nozzles may initially be packaged in individual boxes and thereafter placed in a cardboard shipping carton which is shipped to a retail store. However, in some package designs, the sprinklers or spray nozzles may be placed directly into the shipping carton without the use of individual boxes. In any event, once received by the retail store, the shipping cartons are cut or otherwise opened such that the products therein may be removed and thereafter placed on a retail shelf within the store. Alternatively, the top and one or more of the sides of the shipping carton may be cut and thereafter removed by retail personnel so that the products within the remaining portion of the shipping carton can be displayed to customers.

However, such prior art shipping and displaying arrangements for use with such products likewise have a number of drawbacks associated therewith. For example, in the case of when the sprinklers and spray nozzles are removed from the shipping carton in order to individually placed on a retail shelf, the retailer must expend a relatively large amount of labor in order initially stock and thereafter maintain (e.g. restock) the products on the retail shelf. Moreover, as sprinklers or spray nozzles are removed from the front of the retail shelf, the retailer must provide additional labor in order to front the remaining sprinklers and spray nozzles located in the rear of the retail shelf thereby further undesirably increasing costs to the retailer. Moreover, in the case of where a portion of the shipping carton is cut and removed so that the remaining portion of the carton may be utilized to display the products therein, the retailer must provide relatively large amounts of labor in order to perform the multiple cuts which are necessary to prepare a single carton. Similarly to when the products are removed from the carton for display directly on the retail shelf, retail labor must be provided to front the products within the cutaway shipping carton when the products near the front of the carton are sold or otherwise removed.

Also, certain products such as rubber hose washers or spray nozzles are sold as "bulk" items. Such bulk products are not individually wrapped, boxed, or otherwise packaged, but rather are placed in substantially-horizontal hoppers or bins for display to a customer. Use of heretofore designed hoppers and bins is disadvantageous in that the remaining product within the hopper or bin may be difficult for a customer to view once the product level in the hopper or bin is lowered by, for example, sale to previous customers.

Moreover, a retailer typically maintains a certain amount of back stock of the bulk product. Back stock is an amount of product which is remaining after the hopper or bin containing the bulk product has been filled. Typically such back stock is maintained it the boxes or other type of container in which the product was shipped to the retailer. Typically the back stock boxes are stored in shelf locations above or below the shelf on which the hopper or bin is positioned. Such placement of the back stock boxes often renders the boxes difficult to find and/or access. In particular, since the back stock boxes are not located in the same general location as the hopper or bin containing the bulk product, a retailer may overlook the fact that it actually has quantities of the back stock remaining and unnecessarily order additional product.

What is needed therefore is a packaging assembly which overcomes one or more of the above-mentioned drawbacks. What is particularly needed is a package assembly which may be utilized to ship and display a product which does not require a relatively large amount of retail labor to maintain.

What is also particularly needed is a retail assembly which may be utilized to both display a product while also conveniently maintaining back stock of the product.

SUMMARY OF THE INVENTION

In accordance with one embodiment of the present invention, there is provided a retail apparatus for storing and displaying a product. The apparatus includes a base member and a rack assembly movably secured to the base member. The rack assembly has a product bin and a storage rack. The storage rack is substantially horizontally disposed, whereas the product bin is positioned at an inclined orientation relative to the storage rack.

In accordance with another embodiment of the present invention, there is provided a method of storing and displaying a number of products. The method includes the step of providing a substantially horizontally disposed base member. The method also includes the step of movably securing a rack assembly to the base member, with the rack assembly having a product bin and a storage rack. The storage rack is substantially horizontally disposed, and the product bin is positioned at an inclined orientation relative to the storage rack. The method also includes the step of positioning a first plurality of the number of products in the product bin. In addition, the method includes the step of storing a second plurality of the number of products in a container positioned on the storage rack.

In accordance with a further embodiment of the present invention, there is provided a retail apparatus for storing and displaying a product. The apparatus includes a base member having a roller surface associated therewith and a rack assembly having a number of rollers rotatably secured thereto. The rack assembly has a product bin and a storage rack. The storage rack is substantially horizontally disposed. The product bin is positioned at an inclined orientation relative to the storage rack. The rollers are positioned in contact with the roller surface so as to allow the rack assembly to roll relative to the base member.

It is therefore an object of the present invention to provide a new and useful retail apparatus for storing and displaying a product.

It is moreover an object of the present invention to provide an improved retail apparatus for storing and displaying a product.

It is a further object of the present invention to provide a new and useful method for storing and displaying a product.

It is also an object of the present invention to provide an improved method for storing and displaying a product.

It is moreover an object of the present invention to provide a package assembly which may be utilized to store and display a product which does not require a relatively large amount of retail labor to maintain.

It is also an object of the present invention to provide a retail assembly which may be utilized to both display a product while also conveniently maintaining back stock of the product.

The above and other objects, features, and advantages of the present invention will become apparent from the following description and the attached drawings.

DETAILED DESCRIPTION OF THE INVENTION

Figure 1:
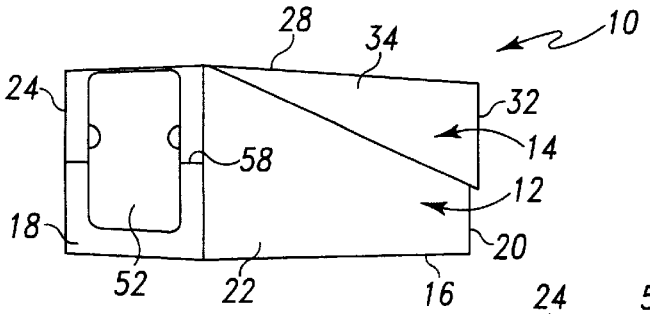
FIGS. 1–5 are perspective views of a product shipping and displaying carton assembly which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 3:
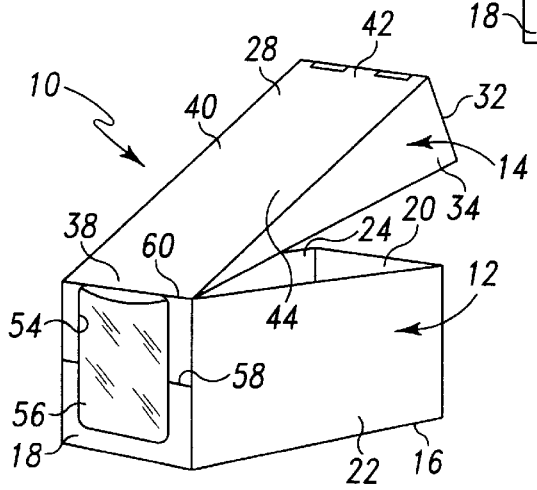
Figure 4:
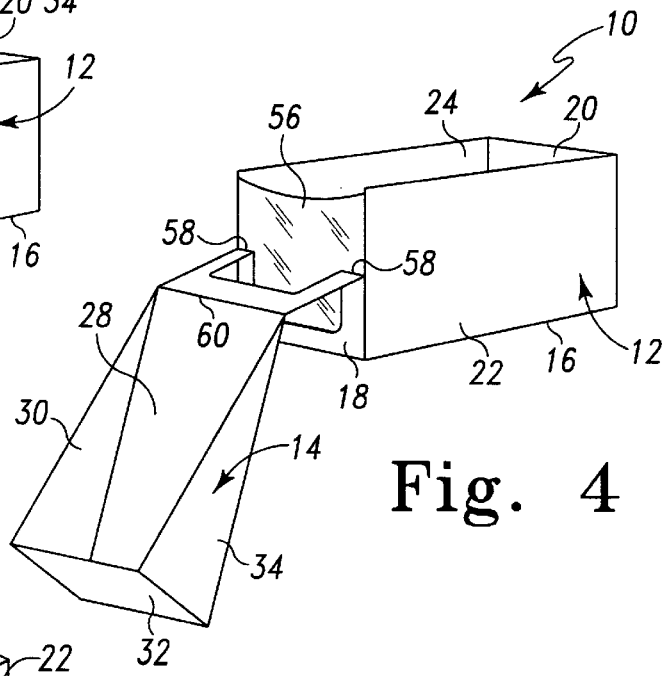
Figure 5:
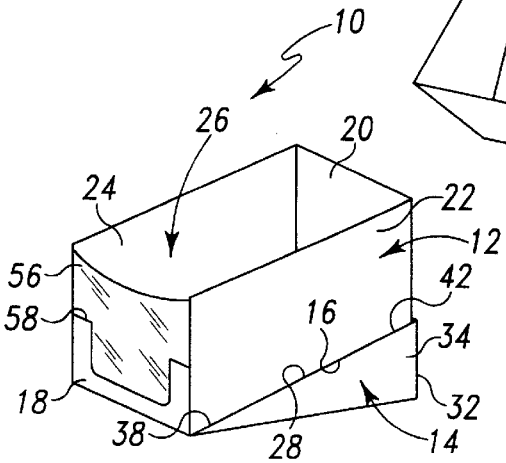

Referring now to FIGS. 1–5, there is shown a shipping and displaying carton assembly 10 which may be utilized to ship and thereafter display a product such as a sprinkler or spray nozzle. The carton assembly 10 includes a carton base 12 and a carton lid 14. The carton base 12 includes a bottom wall 16 which has a number of sidewalls 18, 20, 22, 24 extending therefrom. As shown in FIG. 5, the sidewalls 18, 20, 22, 24 cooperate so as to define an interior void 26 into which products may be positioned for shipment and subsequent display.

Figure 2:
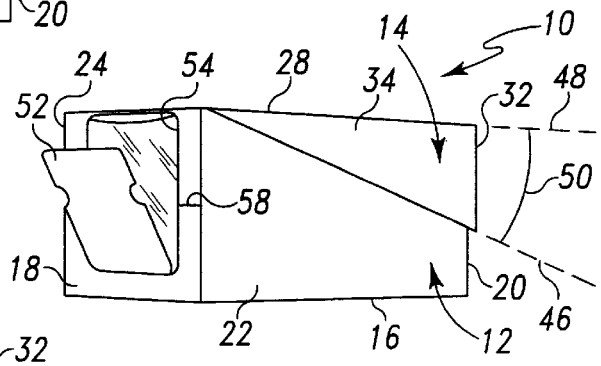

The carton lid 14, on the other hand, includes a top wall 28 which has a number of sidewalls 30, 32, 34 extending therefrom. In particular, the top wall 28 is substantially rectangular shaped thereby defining four edge portions 38, 40, 42, 44 (see FIG. 3). As shown in FIGS. 2–4, a proximal end of each of the lid sidewalls 30, 32, 34 is secured to the edge portions 40, 42, 44 of the top wall 28, respectively. The remaining edge portion of the top wall 28 of the carton lid, i.e. the edge portion 38, is secured to the front sidewall 18 of the carton base 12. The distal end of each of the lid sidewalls 30, 32, 34 lie along a first plane which, for clarity of description, is shown as a single line 46 in FIG. 2, whereas the top wall 28 itself defines a second plane which, also for clarity of description, is shown as a single line 48 in FIG. 2. The two planes 46, 48 intersect one another so as to define a ramp angle 50. The ramp angle 50 may be embodied at any angle which fits the needs of a given carton assembly. In one exemplary embodiment, the ramp angle 50 is provided between 5° and 45°. In a more specific exemplary embodiment, the ramp angle 50 is provided at 15°. As shall be described below in greater detail, such a configuration of the carton lid 14 positions the carton base 12 at a desirable angle when the carton assembly 10 is being utilized to display a product thereby providing for gravity feeding of the products within the carton assembly 10.

As shown in FIGS. 1 and 2, the carton assembly 10 also includes a removable insert panel 52. The insert panel 52 is provided to conceal and protect product within the carton assembly 10 during shipment thereof. In particular, the front sidewall 18 of the carton base 12 has a product viewing opening 54 defined therein. The insert panel 52 is positionable in the product viewing opening 54 so as to obstruct the opening 54 during shipment of the carton assembly 10 thereby protecting the contents of the carton assembly 10. However, prior to placement of the carton assembly 10 onto a retail shelf or the like, the insert panel 52 may be removed thereby exposing the product viewing opening 54 and hence the contents of the carton assembly 10.

The carton assembly 10 also includes a viewing window 56 which is positioned in the product viewing opening 54. The viewing window 56 is preferably constructed of a transparent material such as plastic so as to permit viewing of the contents of the carton assembly 10 by a customer. The product viewing window 56 is provided to prevent products within the carton assembly 10 from falling out of the carton assembly 10 while also allowing a customer to view the contents of the carton assembly 10.

The front sidewall 18 of the carton base 12 has a fold line 58 defined therein. The fold line 58 may be weakened in any manner such as by scoring or perforation. The fold line 58 is provided to allow the carton lid 14 to be folded under the carton base 12. In particular, in order to move the carton lid 14 from a closed lid position in which the carton lid 14 covers the interior void 26 (as shown in FIG. 1) to an open lid position in which the carton lid 14 is utilized to support the carton base 12 at a desired inclined or ramped angle (as shown in FIG. 5), the front sidewall 18 is folded along the fold line 58 (see FIG. 4). Hence, in order to move the carton lid 14 from its closed lid position to its open lid position, the carton lid 14 is initially lifted and thereafter hinged or otherwise folded about a fold line 60 defined at the intersection of the front edge portion 38 of the top wall 28 of the carton lid 14 and the front base sidewall 18 of the carton base 12 (see FIG. 3). Thereafter, the front base sidewall 18 of the carton base 12 is folded along the fold line 58 (see FIG. 4) in order to allow the carton lid 14 to be advanced to a position under the carton base 12 such that the carton base 12 may be supported thereon. As shown in FIG. 5, when positioned in its open lid position, the top wall 28 of the carton lid 14 contacts the bottom wall 16 of the carton base 12. In addition, as also shown in FIG. 5, the tapered design of the lid sidewalls 34, 30 causes the edge portion 42 of the top wall 28 of the carton lid 14 to be located above the edge portion 38 of the top wall 28 when the carton lid 14 is positioned in its open lid position.

As shown in FIG. 5, when the carton base 12 is supported on the carton lid 14, the ramp-shaped, inclined configuration of the carton lid 14 causes the carton base 12 to be likewise positioned at an inclined orientation. As mentioned above, in one exemplary embodiment, the carton lid 14 is configured to include a 15° ramp angle 50. Hence, when supported by the carton lid 14, the carton base 12 also assumes a 15° incline relative to a horizontally flat surface on which the carton assembly 10 is positioned. It should be appreciated that positioning the carton base 12 at such an inclined angle provides numerous advantages to the carton assembly 10 in regard to the display of products therein. For example, the downwardly inclined angle of the carton base 12 allows products within the carton assembly 10 to be readily viewed by a customer through the viewing window 56. This is particularly true when the carton assembly 10 is positioned on a retail shelf that is located at or above the customer's eye level.

Moreover, the positioning of the carton base 12 at an inclined angle provides for gravity feeding of the products within the carton assembly 10. In particular, when a customer purchases or otherwise removes one of the products from the front of the carton base 12 (i.e. from the end of the carton base 12 nearest the viewing window 56), the remaining products within the carton base 12 slide downwardly along the bottom wall 16 of the carton base 12 due to the inclined angle at which the carton base 12 is oriented. It should be appreciated that such gravity feeding of the products within the carton assembly 10 eliminates the need for a retailer to expend labor to front the product within the carton assembly 10.

Referring now to FIGS. 6–9, there is shown an alternative embodiment of the carton assembly 10 which is hereinafter referred to as a carton assembly 10'. The carton assembly 10' is somewhat similar to the carton assembly 10. Accordingly, the carton assembly 10' includes a number of components which are identical to components previously discussed in regard to the carton assembly 10. The same reference numerals are utilized in FIGS. 6–9 to designate identical components which were previously discussed in regard to FIGS. 1–5 and additional discussion thereof is not warranted.

Figure 6:
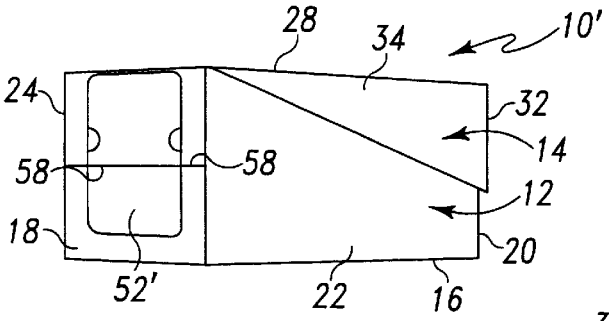
FIGS. 6–9 are perspective views of an alternative embodiment of the product shipping and displaying carton assembly of FIGS. 1–5.
Figure 7:
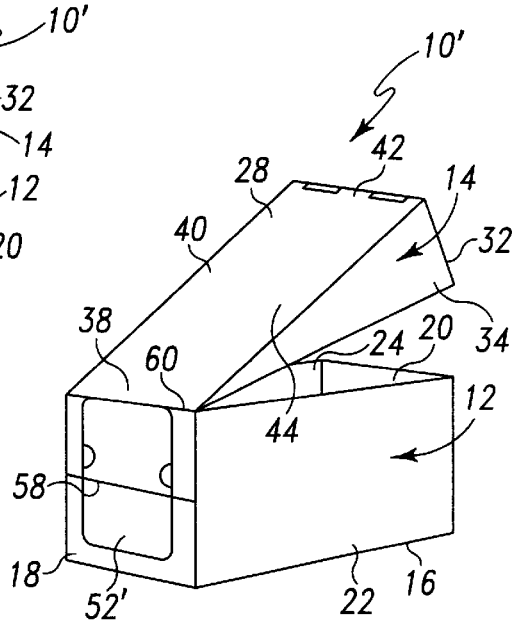
Figure 8:
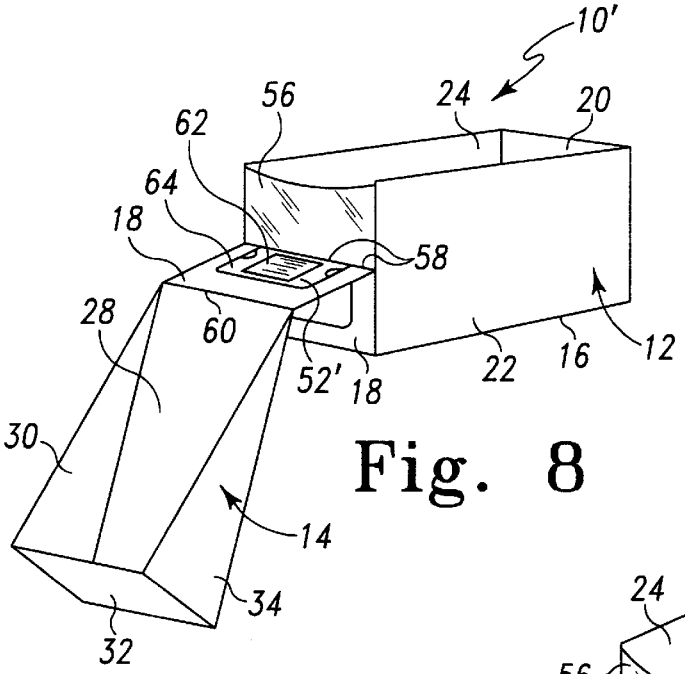
Figure 9:
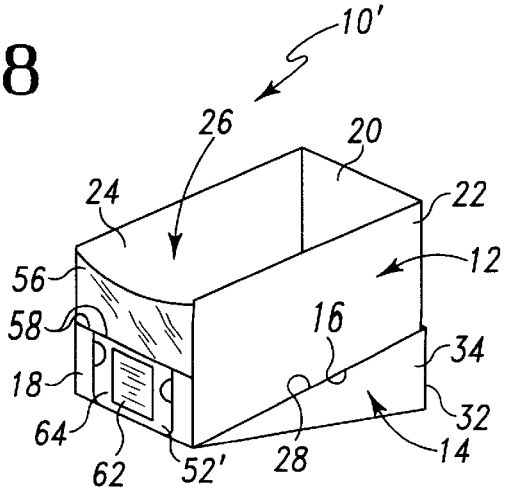
Figure 10:
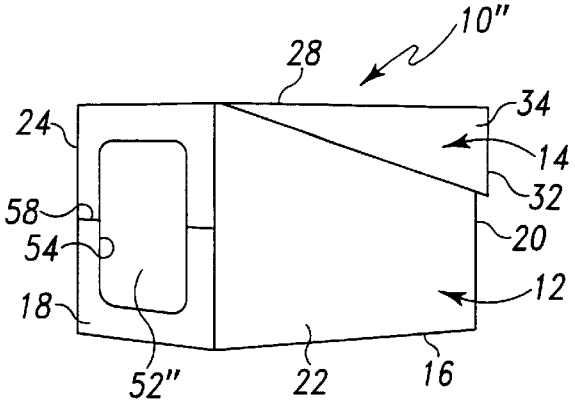
FIGS. 10–13 are perspective views of another alternative embodiment of the product shipping and displaying carton assembly of FIGS. 1–5.
Figure 11:
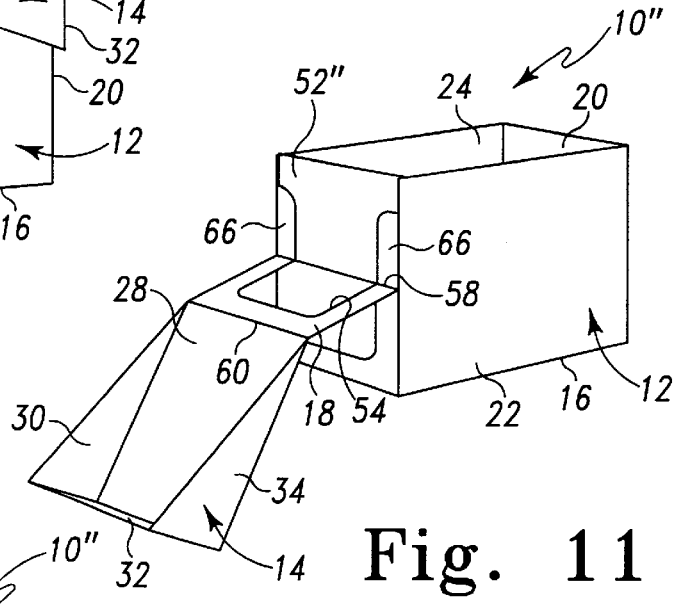
Figure 12:
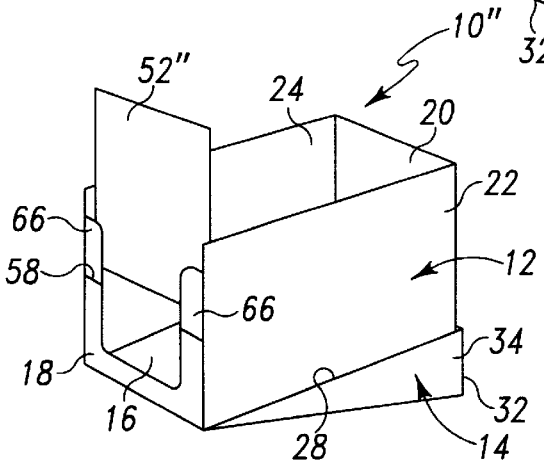
Figure 13:
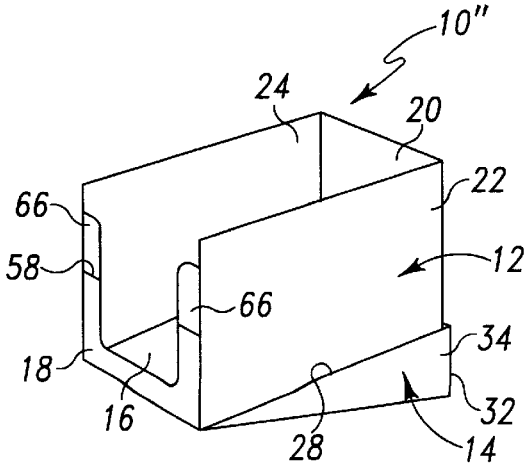

As with the carton assembly 10, the carton assembly 10' includes an insert panel which is positioned in the product viewing opening 54 (hereinafter designated with the reference numeral 52'). However, unlike the removable insert panel 52 of the carton assembly 10, the insert panel 52' of the carton assembly 10' is not removed prior to opening of the carton assembly 10' (i.e. prior to movement of the carton lid 14 from its closed lid position to its open lid position). In particular, the fold line 58 which is utilized to allow for folding of the font base sidewall 18 of the carton base 12 is extended across the insert panel 52' in order to allow the insert panel 52' to likewise fold during movement of the carton lid 14 from its closed lid position (as shown in FIG. 6) to its open lid position (as shown in FIG. 9).

Such folding of the insert panel 52' is particularly useful to allow for labeling or other type of marking of the carton assembly 10'. In particular, during packing of the carton assembly 10', a label 62 such as a price and/or product description label, may be placed on an inner surface 64 of the insert panel 52'. Hence, as shown in FIG. 9, subsequent to folding of the insert panel 52' during movement of the carton lid 14 from its closed lid position to its open lid position, the label 62 is positioned so as to be viewable by a customer or the like. It should be appreciated that any type of information or indicia may be printed on the label including, for example, bar codes or other types of indicia. Moreover, it should also be appreciated that the label 62 may not be provided as a separate component, or alternatively, may be printed, stamped, or otherwise provided for directly on the inner surface 64 of the insert panel 52'.

Referring now to FIGS. 10–13, there is shown another alternative embodiment of the carton assembly 10 which is hereinafter referred to as a carton assembly 10". The carton assembly 10" is somewhat similar to the carton assemblies 10, 10'. Accordingly, the carton assembly 10" includes a number of components which are identical to components previously discussed in regard to the carton assemblies 10, 10'. The same reference numerals are utilized in FIGS. 10–13 to designate identical components which were previously discussed in regard to FIGS. 1–9 and additional discussion thereof is not warranted.

In lieu of an insert panel which is interference fit into the product viewing opening 54, the carton assembly 10" includes a substantially rectangular-shaped insert panel 52" which is slid into and out of the carton base 12 at a location behind the product viewing opening 54. In such a manner, the insert panel 52" may be utilized to conceal and protect product within the carton assembly 10" during shipment thereof, but then, prior to placement of the carton assembly 10 onto a retail shelf or the like, the insert panel 52 may be slid out or otherwise removed from the carton base 12 thereby exposing the product viewing opening 54 and hence the contents of the carton assembly 10.

Moreover, the front base sidewall 18 has a pair of retaining flanges 66 defined therein. The retaining flanges 66 are provided to retain product within the carton assembly 10" in lieu of the viewing window 56. The retaining flanges 66 are particularly useful for retaining products which are stacked upon one another within the carton assembly 10". For example, in certain packaging configurations, it is desirable to stack two layers of product boxes within the shipping carton 10". In such a configuration, the retaining flanges 66 prevent product boxes from the top layer from falling out of the carton assembly 10" during gravity feeding thereof.

Figure 14:
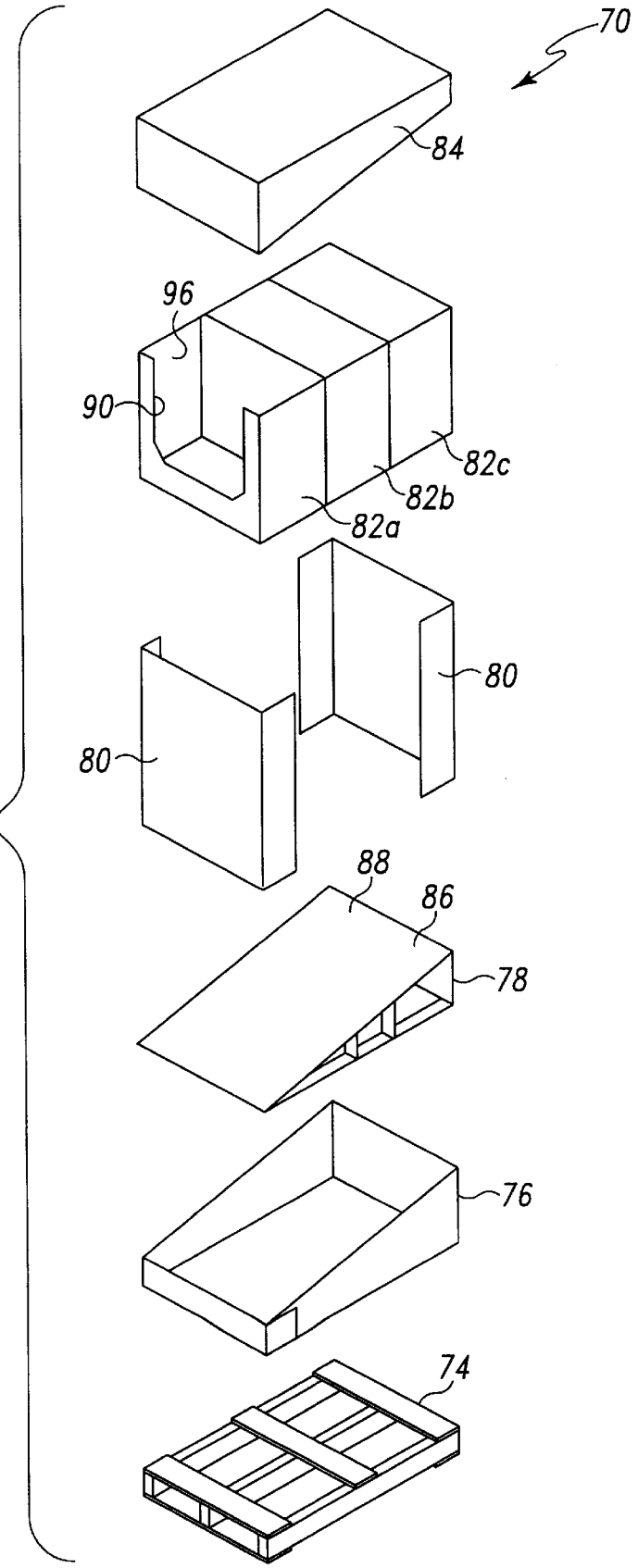
FIG. 14 is an exploded perspective view of a shipping and displaying pallet assembly which incorporates the features of the present invention therein.
Figure 15:
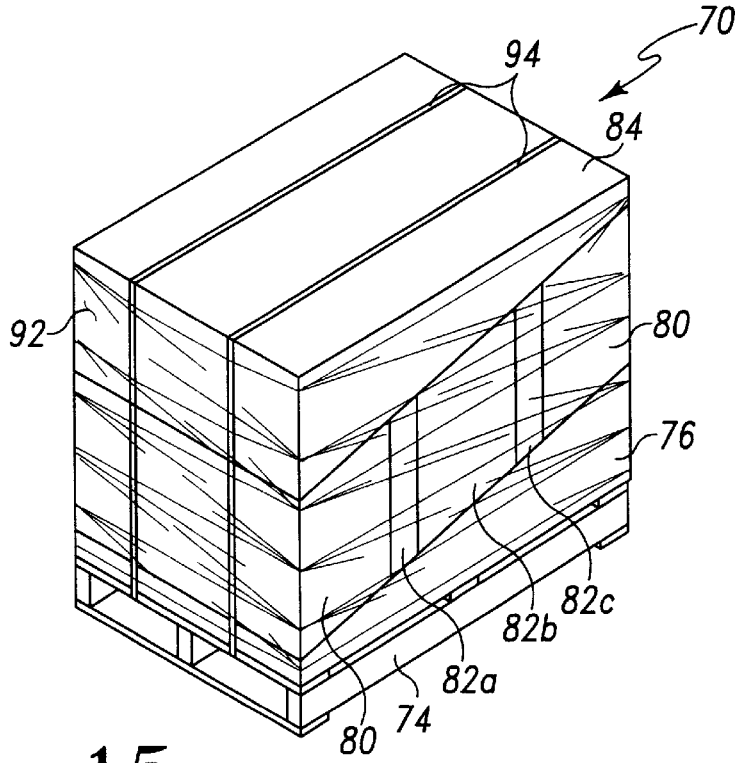
FIG. 15 is a perspective view of the shipping and displaying pallet assembly of FIG. 14 which shows the pallet assembly prepared for product shipment.
Figure 16:
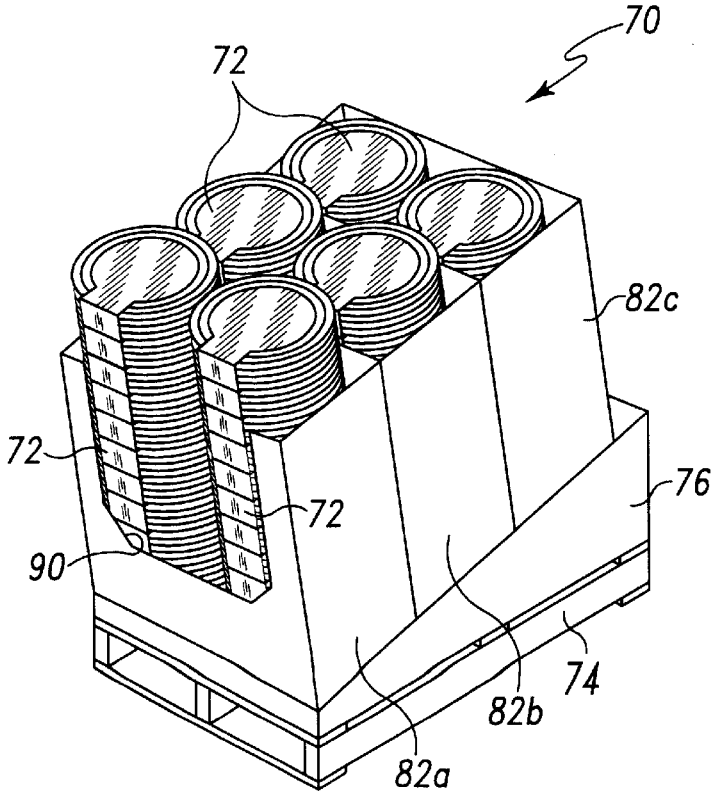
FIG. 16 is a view similar to FIG. 15, but showing the pallet assembly prepared for product display.

Referring now to FIGS. 14–16, there is shown a pallet assembly 70 which may be utilized to ship and thereafter display a product such as pre-packaged sections of coiled garden hose 72. The pallet assembly 70 includes a pallet 74, a lower lid 76, a base 78, a pair of end caps 80, a number of product receptacles 82*a–c,* and an upper lid 84. In one exemplary embodiment, the pallet 74 is constructed of relatively rigid material such as wood or plastic, whereas the remaining components (i.e. the lids 76, 84, the base 78, the end caps 80, and the product receptacles 82*a–c)* are constructed of a lighter weight material such as cardboard.

The lower lid 76 and the base 78 are stapled, glued, or otherwise secured to the pallet 74 so as to define base structure for supporting the product receptacles 82*a–c*. Moreover, an upper surface 86 of the base 78 defines an inclined surface 88. In one exemplary embodiment, the inclined surface 88 is provided at an inclined angle between 5° and 45° relative to a substantially flat surface such as a floor. In a more specific exemplary embodiment, the inclined surface 88 is provided at 15° relative to a substantially flat surface. Similarly to as discussed above in regard to the carton assembly 10, use of the inclined surface 88 provides for gravity feeding of the product receptacles 82*a–c* during display of the hose sections 72. In particular, during display of the hose sections 72, as one of the product receptacles 82*a–c* is emptied by, for example, sale of all of the hose sections 72 therein, the empty product receptacle is removed from atop the base 78 thereby causing the remaining product receptacles to slide forward along the inclined surface 88. It should be appreciated that such gravity feeding of the product receptacles 82 eliminates the need for a retailer to expend labor to front the product (e.g. the hose sections 72) within the pallet assembly 70.

The end caps 80 are provided to protect and support the pallet assembly 70 during shipment thereof. In particular, each of the product receptacles 82*a–c* have a product viewing opening 90 defined therein which, as shown in FIG. 16, allows the hose sections 72 to be viewed by a customer during display thereof. As shown in FIG. 15, during shipment of the pallet assembly 70, the end caps 80 obstruct the product viewing openings 90 of the end caps 80 thereby protecting the products (e.g. the hose sections 72) within the product receptacles 82*a–c*. As shown in FIG. 15, the end caps 80 and the upper lid 84 are secured to the pallet assembly 70 by use of shrink wrap 92 or other types of film along with a number of plastic bands or straps 94. However, once the pallet assembly 70 has arrived at the retail site, the shrink wrap 92 and the plastic bands 94 are removed. Thereafter, the end caps 80 and the upper lid 84 are removed so as to expose the products (e.g. the hose sections 72) within an interior void or inside portion 96 of each of the product receptacles 82*a–c*.

Moreover, in order to provide the pallet assembly 70 with a flat upper surface so as to allow a number of pallet assemblies 70 to be stacked on one another, the hose sections 72 may be stacked in stacks of varying heights. In particular, if an equal number of hose sections 72 were stacked in each of the product receptacles 82*a–c,* the upper surface of the pallet assembly 70 would assume the same inclined angle as the inclined surface 88 of the base 78 thereby preventing other pallet assemblies from being stacked thereon. However, in order to overcome this, as shown in FIG. 16, a greater number of hose sections 72 are stacked in the forward or front product receptacle 82*a* relative to the middle product receptacle 82*b*. The middle product receptacle 82*b* in turn includes higher stacks of the hose sections 72 relative to the rear product receptacle 82*c*. Hence, when the upper lid 84 is secured to the pallet assembly 70, the differences in height of the stacks of hose sections 72 offsets the inclined surface 88 of the base 78 thereby providing a substantially flat upper surface onto which other pallet assemblies 70 may be stacked during shipping or storage.

As described above, the pallet assembly 70 provides a single structure for shipping the hose sections 72 from one location to another and thereafter displaying the hose sections 72 at the second location. In particular, the pallet assembly 70 not only functions as a structure for safely and securely shipping the hose sections 72 from a distribution site to a retail site, but also provides a structure for displaying the products at the retail site. What is meant herein by the term "retail site" is a store or other building location where the carton or pallet assemblies described herein are positioned or otherwise located during sale of the goods contained therein. Examples of retail sites include hardware stores or home improvement stores. Moreover, what is meant herein by the term "distribution site" is a location or site which is remote from the retail site where the carton or pallet assemblies described herein are filled with product prior to shipment to the retail site. Examples of distribution sites include the factories where the products are made, warehouses, distribution centers, or packaging centers.

Figure 17:
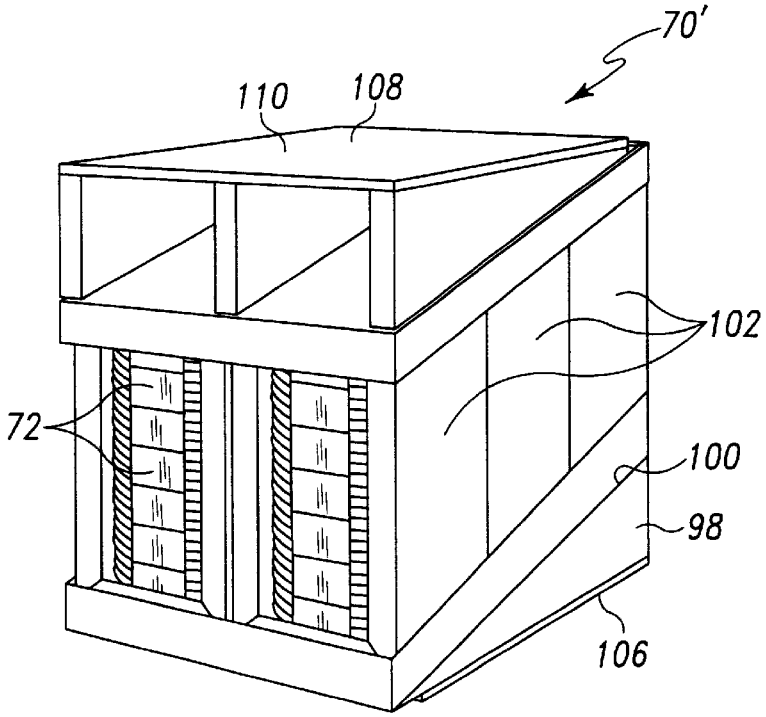
FIG. 17 is a view similar to FIG. 15, but showing an alternative embodiment of the shipping and displaying pallet assembly.
Figure 18:
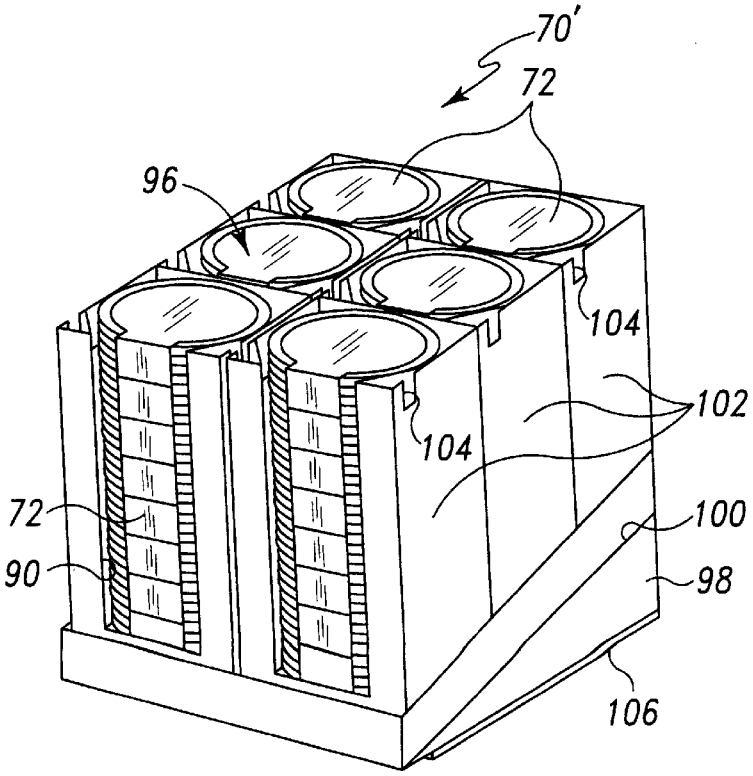
FIG. 18 is a view similar to FIG. 16, but showing the alternative embodiment of the shipping and displaying pallet assembly of FIG. 17.

Referring now to FIGS. 17 and 18, there is shown a pallet assembly 70'. The pallet assembly 70' is somewhat similar to the pallet assembly 70 and it is similarly utilized to ship and display products such as the hose sections 72. Accordingly, similar reference numerals have been utilized to designate components or features which are common between the pallet assembly 70 and the pallet assembly 70'. The pallet assembly 70' is constructed primarily of, for example, corrugated cardboard and includes an integrally constructed base 98. In particular, in lieu of the pallet 74, the lower lid 76, and the base 78 of the pallet assembly 70, the pallet assembly 70' includes the integrally constructed base 98. As with the base 78 of the pallet assembly 70, the base 98 has an inclined surface 100 associated therewith. Similarly to as discussed above in regard to the pallet assembly 70, use of the inclined surface 100 provides for gravity feeding of a number of product receptacles 102 during display of the hose sections 72. In particular, during display of the hose sections 72, as a product receptacle 102 is emptied by, for example, sale of all of the hose sections 72 therein, the empty product receptacle 102 is removed from atop the inclined surface 100 of the base 98 thereby causing the remaining product receptacles 102 to slide forward along the inclined surface 100. It should be appreciated that such gravity feeding of the product receptacles 102 eliminates the need for a retailer to expend labor to front the product (e.g. the hose sections 72) within the pallet assembly 70'. As with the inclined surface 88 of the pallet assembly 70, in one exemplary embodiment, the inclined surface 100 of the base 98 is provided at an inclined angle between 5° and 45° relative to a substantially flat surface such as a floor. In a more specific exemplary embodiment, the inclined surface 100 of the base 98 is provided at 15° relative to a substantially flat surface.

As shown in FIG. 18, the product receptacles 102 of the pallet assembly 70' are provided as "single stack" receptacles which hold only a single stack of the hose sections 72 (compared to the "double stack" receptacles 82 of the pallet assembly 70). In this manner, as a single stack of the hose sections 72 are removed from the pallet assembly 70', the next product receptacle 102 may be slid forward. Moreover, in order to provide additional stability during shipping, each of the product receptacles 102 includes a number of locking tabs 104 which may be engaged or otherwise contacted by a locking member or support bar in order to secure the product receptacles 102 to one another.

Moreover, in order to allow the pallet assembly 70' to be moved with a forklift or similar type of material handler, the pallet assembly 70' includes a slip sheet 106. In this manner, use of the slip sheet 106 allows for movement of the pallet assembly 70' with a forklift while also reducing the overall height of the pallet assembly 70' relative to use of a pallet or skid.

The pallet assembly 70' also includes a lid 108. As shown in FIG. 17, the lid 108 is configured in a ramp-like inclined configuration. The lid 108 is positioned on top of the product receptacles 102 in an orientation substantially opposite to the orientation of the base 98. In particular, as shown in FIG. 17, the "low" end of the base 98 is in the front of the pallet assembly 70', whereas the "high" end of the pallet assembly 70' is in the rear of the pallet assembly 70' thereby allowing for gravity feeding of the product receptacles 102 from the rear of the pallet assembly 70' to the front of the pallet assembly 70'. On the other hand, the lid 108 is oriented with its "low" end in the rear of the pallet assembly 70' and its "high" end in the front of the pallet assembly 70'. In such a manner, an upper surface 110 of the lid 108 is oriented substantially flat thereby allowing multiple pallet assemblies 70' to be stacked on one another during shipment or storage thereof.

It should be appreciated that the lid 108 is utilized during shipment of the pallet assembly 70' from the distribution site to the retail site, but is thereafter removed prior to display of the product (e.g. the hose sections 72) at the retail site. Moreover, it should also be appreciated that similarly to the pallet assembly 70, shrink wrap or other types of film, along with a number of plastic bands or straps, may be utilized to secure the pallet assembly 70' during shipment thereof. However, once the pallet assembly 70' has arrived at the retail site, the shrink wrap and the plastic bands are removed in order for the lid 108 to be likewise removed so as to expose the products (e.g. the hose sections 72) within the interior void or inside portion 96 of each of the product receptacles 102.

Figure 19:
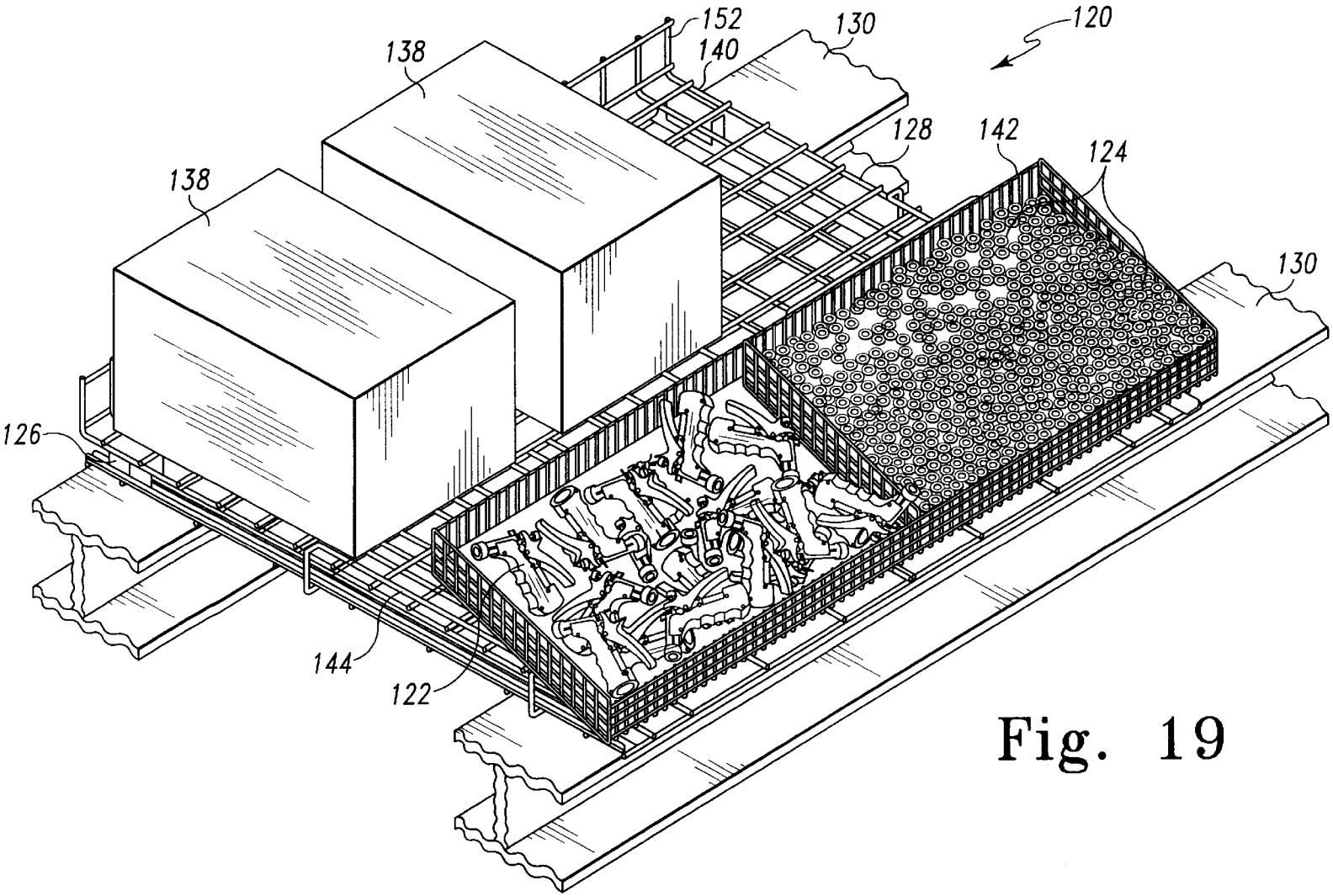
FIG. 19 is a perspective view of a product display and storage assembly which incorporates the features of the present invention therein, note that the rack assembly of the product display and storage assembly is shown in its retracted position.
Figure 20:
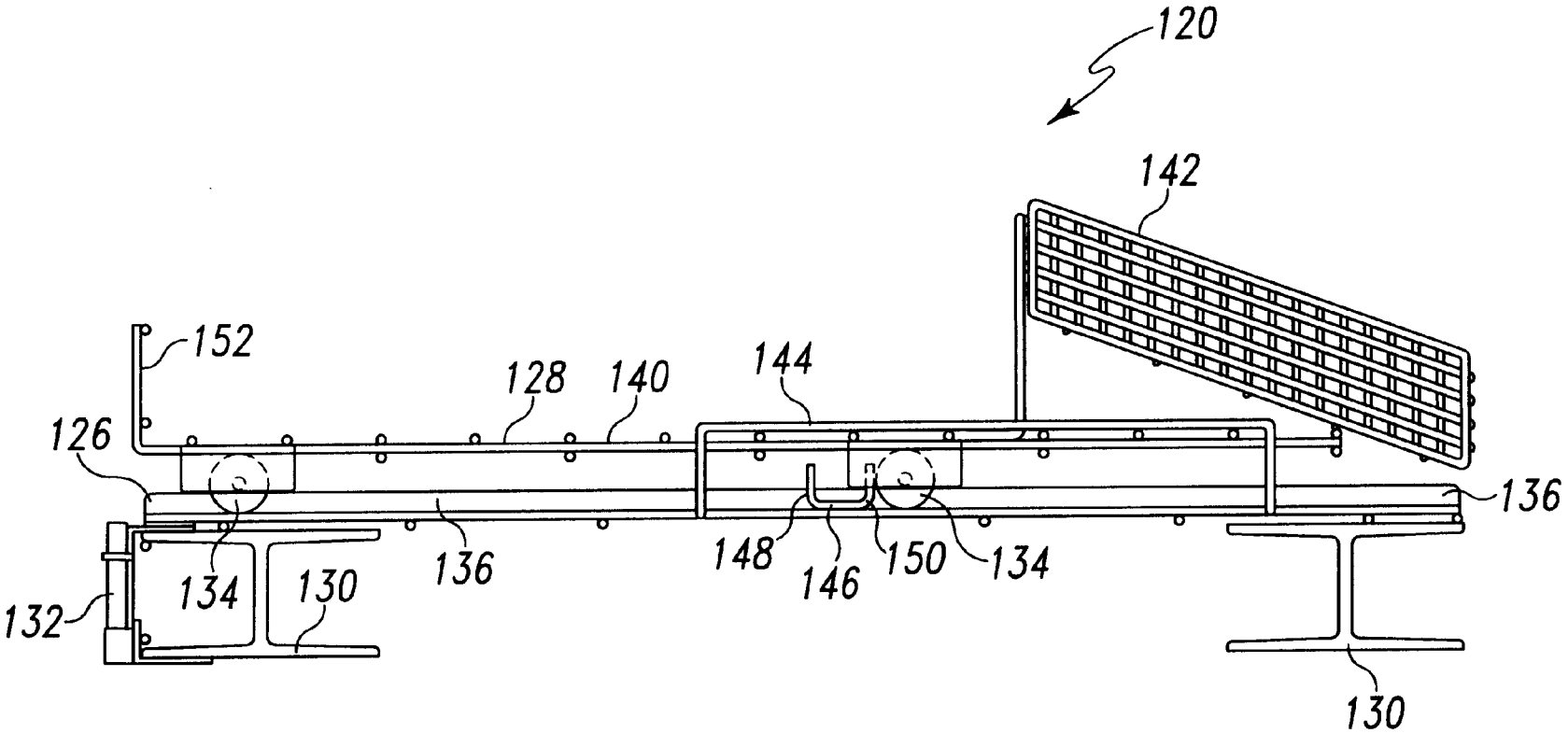
FIG. 20 is a side elevational view of the product display and storage assembly of FIG. 19.
Figure 21:
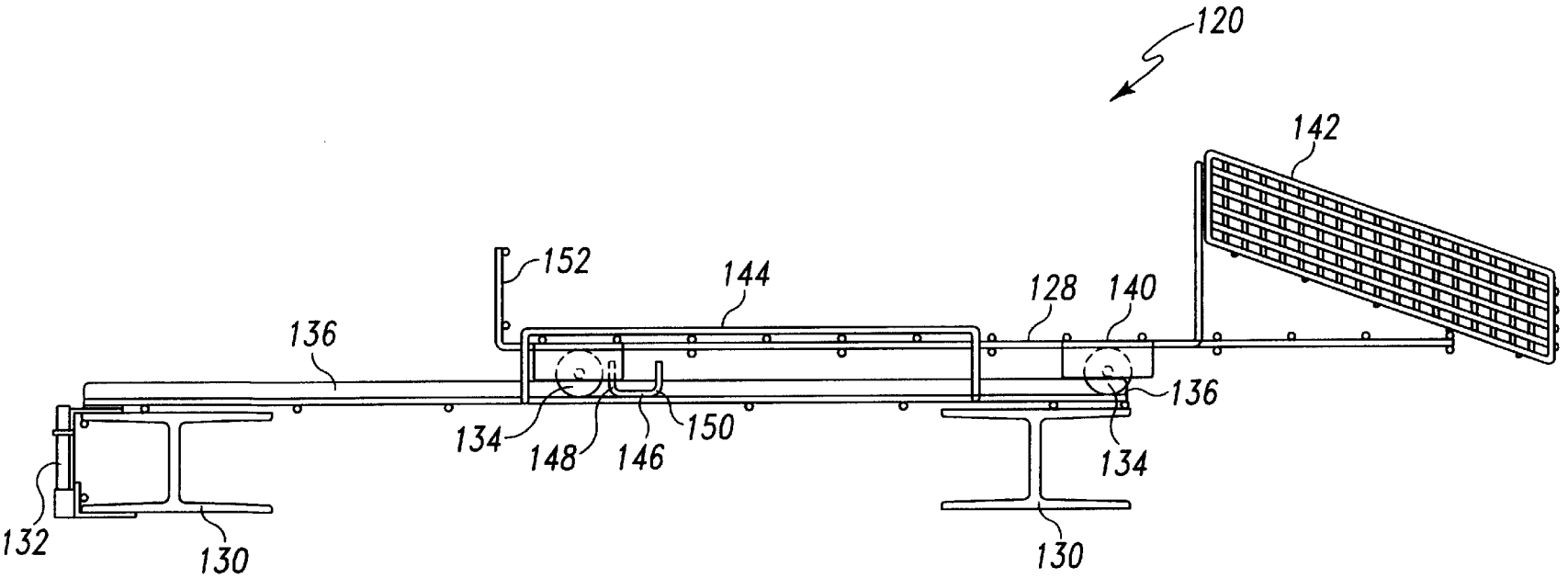
FIG. 21 is view similar to FIG. 20, but showing the rack assembly of the product display and storage assembly positioned in its extended position.

Referring now to FIGS. 19–21, there is shown a product storage and display assembly 120 for storing and displaying a bulk product such as spray nozzles 122 and hose washers 124. As shall be discussed below in greater detail, the storage and display assembly 120 provides for the display of the bulk product while also providing a convenient, easily-accessed storage location for the back stock of the bulk product.

The storage and display assembly 120 includes a lower base member 126 and an upper rack assembly 128. The lower base member 126 is secured to a shelf assembly 130. The shelf assembly 130 is of the type which is commonly found in retail sites such as hardware stores, home improvement stores, and the like. As shown in FIGS. 20 and 21, a mounting bracket 132 is utilized to secure the lower base member 126 to the shelf assembly 130; however, it should be appreciated that the lower base member 126 may be secured to the shelf assembly 130 in any number of manners.

The upper rack assembly 128 is movably secured to the lower base member 126. In particular, the upper rack assembly 128 has a number of rollers 134 rotatably secured thereto. The rollers 134 are positioned in contact with a roller surface 136 associated with the lower base member 126. In such a manner, the rollers 134 roll along the roller surface 136 thereby allowing the upper rack assembly 128 to be rolled or otherwise moved from a retracted rack position (as shown in FIGS. 19 and 20) to an extended rack position (as shown in FIG. 21). As shall be discussed below in greater detail, such movement of the upper rack assembly 128 relative to the lower base member 126 provides access to a number of storage containers such as back stock boxes 138 or the like.

The upper rack assembly 128 includes a substantially flat storage rack 140 and a product bin 142. As shown in FIGS. 19–21, in one exemplary embodiment, both the storage rack 140 and the product bin 142 are constructed in a wire grid arrangement. Moreover, as shown most clearly in FIGS. 20 and 21, the storage bin 142 is positioned at an inclined orientation relative to the storage rack 140. In one exemplary embodiment, the angle at which the storage bin 142 is positioned relative to the storage rack 140 is between 5° and 45°. In a more specific exemplary embodiment, the angle at which the storage bin 142 is inclined relative to the storage rack 140 is 15°. Such an orientation positions the storage bin 142 at a desirable angle in order to display products therein along with providing for gravity feeding of the products within the storage bin 142.

The lower base member 126 has a retainer 144 secured thereto. As shown most clearly in FIG. 19, the retainer 144 wraps around and engages a top surface of the storage rack 140 thereby securing the rack assembly 128 to the lower base member 126. Moreover, the lower base member 126 also has a stop member 146 secured thereto (see FIGS. 20 and 21). The stop member 146 is provided to stop the advancement of the rack assembly 128 as it is moved between its extended rack position and its retracted rack position. In particular, when the rack assembly 128 is advanced into its extended rack position (as shown in FIG. 21) a rear roller 134 contacts a rear surface 148 of the stop member 146. However, when the rack assembly 128 is advanced to its retracted rack position (as shown in FIGS. 19 and 20), a front roller 134 contacts a front surface 150 of the stop member 146.

The storage rack 140 also has an upwardly turned rear gate 152. The rear gate 152 prevents items supported on the storage rack 140 such as the back stock boxes 138 from falling off of the rear of the storage rack 140 during movement of the rack assembly 128.

As described above, the rack assembly 128 is movable between its retracted rack position (as shown in FIGS. 19 and 20 ) and its extended rack position (as shown in FIG. 21). Such a configuration provides numerous advantages to the product storage and display assembly 120 during its use at a retail site. In particular, as shown in FIG. 19, the product bins 142 may be filled with products which are sold in bulk such as the spray nozzles 122 or the rubber washers 124. Any remaining stock of the bulk products (i.e. "back stock" or, in other words, bulk products leftover from filling of the product bins 142) are stored in the boxes 138. It should be appreciated that the back stock boxes are generally the boxes in which the bulk products are shipped to the retail site. The back stock boxes 138 are stored on the storage rack 140 of the rack assembly 128. In this manner, when the rack assembly 128 is positioned in its retracted rack position (as shown in FIGS. 19 and 20), the back stock boxes 138 are neatly tucked away within the perimeter of the shelf assembly 130. However, when the product bins 142 are in need of being refilled, the rack assembly 128 may be advanced to its extended rack position (as shown in FIG. 21) in order to allow access to the back stock boxes 138 by retail personnel.

Hence, as described above, the product storage and display assembly 120 has numerous advantages over heretofore designed assemblies. For example, the inclined orientation of the product bin 142 relative to the storage rack 140 allows for gravity feeding of the products within the product bin 142 thereby reducing the amount of retail labor required to maintain the product level within the product bin 142. Moreover, by placing the back stock boxes 138 on the rolling rack assembly 128, the boxes 138 may be easily accessed by retail personnel when the product bins 142 require refilling. This is particularly advantageous when compared to prior practices in which back stock boxes are stored in difficult, hard-to-reach locations either behind a product bin or on a shelf above the bin.

Operation of the Present Invention

In operation, each of the carton assemblies 10, 10', 10", the pallet assemblies 70, 70', and the product storage and display assembly 120 may be utilized to provide numerous advantages to a distribution and/or retail operation. In particular regard to the carton assembly 10 (see FIGS. 1–5), the carton assembly 10 may be utilized to ship and thereafter display a product such as a sprinkler or spray nozzle. More specifically, the carton assembly 10 is initially packed with products at a distribution site such as a factory or packaging center. Once the carton assembly 10 has been packed or otherwise filled with the requisite quantity of products, the carton lid 14 is positioned in its closed lid position (as shown in FIG. 1) in which the carton lid 14 covers the access opening 26 of the carton base 12 thereby protecting the products within the carton assembly. Note that an adhesive may be utilized to secure the carton lid 14 in its closed lid position. Once packaged in such a manner, the carton assembly 10 (and hence the products contained therein) may be shipped from the distribution site to the retail site.

Prior to placement of the carton assembly 10 onto a retail shelf or the like at the retail site, the insert panel 52 is removed thereby exposing the product viewing opening 54 and hence the contents of the carton assembly 10. Thereafter, the carton lid 14 is moved from its closed lid position in which the carton lid 14 covers the interior void 26 (as shown in FIG. 1) to its open lid position in which the carton lid 14 is utilized to support the carton base 12 at a desired inclined or ramped angle (as shown in FIG. 5). In particular, the carton lid 14 is initially lifted and thereafter hinged or otherwise folded about the fold line 60 defined at the intersection of the front edge portion 38 of the top wall 28 of the carton lid 14 and the front base sidewall 18 of the carton base 12 (see FIG. 3). Thereafter, the front base sidewall 18 of the carton base 12 is folded along the fold line 58 (see FIG. 4) in order to allow the carton lid 14 to be advanced to a position under the carton base 12 such that the carton base 12 may be supported thereon. Once the carton lid 14 is opened in such a manner, the carton assembly 10 may be positioned on a retail shelf or other substantially flat surface so as to be accessible by customers.

Moreover, as shown in FIG. 5, when the carton base 12 is supported on the carton lid 14, the ramp-shaped, inclined configuration of the carton lid 14 causes the carton base 12 to likewise be position at an inclined orientation. As mentioned above, in one exemplary embodiment, the carton lid 14 is configured to include a 15° ramp angle 50. Hence, when supported by the carton lid 14, the carton base 12 also assumes a 15° incline relative to a horizontally flat surface on which it is positioned. It should be appreciated that the downwardly inclined angle of the carton base 12 allows products within the carton assembly 10 to be readily viewed by a customer through the viewing window 56. Moreover, as described above, positioning of the carton base 12 at an inclined angle provides for gravity feeding of the products within the carton assembly 10. In particular, when a customer purchases or otherwise removes one of the products from the front of the carton base 12 (i.e. from the end of the carton base 12 nearest the viewing window 56), the remaining products in the carton base 12 slide downwardly along the bottom wall 16 of the carton base 12 due to the inclined angle at which the carton base 12 is oriented. It should be appreciated that such gravity feeding of the products within the carton assembly 10 eliminates the need for a retailer to expend labor to front the product within the carton assembly 10.

In regard to the carton assembly 10' (see FIGS. 6–9), the carton assembly 10' would be packaged and thereafter shipped from the distribution site to the retail site in a manner similar to as described above in regard to the carton assembly 10. However, one notable exception is that during packaging of the carton assembly 10', the label 62, which may be a price and/or product description label, is placed on the inner surface 64 of the insert panel 52' (see FIG. 8). Moreover, once received at the retail site, the insert panel 52' of the carton assembly 10' is not removed prior to opening of the carton assembly 10' (i.e. prior to movement of the carton lid 14 from its closed lid position to its open lid position). In particular, as shown in FIGS. 6–9, the fold line 58 which is utilized to allow for folding of the font base sidewall 18 of the carton base 12 is extended across the insert panel 52' in order to allow the insert panel 52' to likewise fold during movement of the carton lid 14 from its closed lid position (as shown in FIG. 6) to its open lid position (as shown in FIG. 9).

Such folding of the insert panel 52' is particularly useful to allow for labeling or other type of marking of the carton assembly 10'. In particular, subsequent to folding of the insert panel 52' during movement of the carton lid 14 from its closed lid position to its open lid position, the label 62 is positioned so as to be viewable by a customer or the like (see FIG. 9). It should be appreciated that any type of information or indicia may be printed on the label including, for example, bar codes or other types of indicia.

In regard to the carton assembly 10" (see FIGS. 10–13), the carton assembly 10" would be packaged and thereafter shipped from the distribution site to the retail site in a manner similar to as described above in regard to the carton assembly 10 except that the removable insert 52" is slid into place during packaging of the carton assembly 10". Moreover, once received at the retail site, and prior to placement of the carton assembly 10 onto a retail shelf or the like, the insert panel 52 may be slid out or otherwise removed from the carton base 12 thereby exposing the product viewing opening 54 and hence the contents of the carton assembly 10. In addition, as products within the carton assembly 10" slide forward during gravity feeding thereof, the retaining flanges 66 are provided to retain product within the carton assembly 10" in lieu of the viewing window 56.

In regard to the pallet assembly 70, the pallet assembly 70 is packaged at a distribution site, shipped from the distribution site to the retail site, and thereafter utilized to display product to a customer at the retail site. In particular, products such as the hose sections 72 are stacked or otherwise positioned in the product receptacles 82*a–c* which are in turn positioned atop the inclined surface 88 of the base 78 (see FIGS. 14–16). In addition, in order to provide the pallet assembly 70 with a flat upper surface so as to allow a number of pallet assemblies 70 to be stacked on one another, the hose sections 72 may be stacked in stacks of varying heights. In particular, a greater number of hose sections 72 are stacked in the front product receptacle 82*a* relative to the middle product receptacle 82*b*, which in turn includes higher stacks of the hose sections 72 relative to the rear product receptacle 82*c*. Thereafter, the upper lid 84 is secured to the pallet assembly 70. The differences in height of the stacks of hose sections 72 offsets the inclined surface 88 of the base 78 thereby providing a substantially flat upper surface onto which other pallet assemblies 70 may be stacked during shipping.

Moreover, prior to shipment of the pallet assembly 70 from the distribution site to the retail site, the end caps 80 are installed in order to protect and support the pallet assembly 10. In addition, as shown in FIG. 15, the end caps 80 and the upper lid 84 are secured to the pallet assembly 70 by use of shrink wrap 92 along with the number of plastic bands or straps 94. Once assembled in the above described manner, the pallet assembly 70 is shipped from the distribution site to the retail site.

Once the pallet assembly 70 has arrived at the retail site, the shrink wrap 92 and the plastic bands 94 are removed. Thereafter, the end caps 80 and the upper lid 84 are removed so as to expose the products (e.g. the hose sections 72) within the inside portion 96 of each of the product receptacles 82*a–c*.

Thereafter, the inclined surface 88 of the base 78 provides for gravity feeding of the product receptacles 82 during display of the hose sections 72. In particular, during display of the hose sections 72 at the retail site, as a product receptacle 82*a–c* is emptied by, for example, sale of all of the hose sections 72 therein, the empty product receptacle 82*a–c* may be removed from atop the base 78. Such removal of the empty product receptacle 82*a–c* causes the remaining product receptacles 82 to slide forward along the inclined surface 88. It should be appreciated that such gravity feeding of the product receptacles 82*a–c* eliminates the need for a retailer to expend labor to front the product (e.g. the hose sections 72) within the pallet assembly 70.

In particular regard to the pallet assembly 70', the pallet assembly 70' would be packaged in a similar manner to that described above in regard to the pallet assembly 70 except that the product receptacles 102 of the pallet assembly 70' are provided as "single stack" receptacles which hold only a single stack of the hose sections 72 (compared to the "double stack" receptacles 82*a–c* of the pallet assembly 70). Hence, a single stack of hose sections is placed in each of the product receptacles 102.

Moreover, during preparation of the pallet assembly 70" for shipment, the lid 108 is positioned on top of the product receptacles 102 in an orientation which is substantially opposite to the orientation of the base 98. In particular, the lid 108 is oriented with its "low" end in the rear of the pallet assembly 70' and its "high" end in the front of the pallet assembly 70'. In such a manner, an upper surface 110 of the lid 108 is oriented substantially flat thereby allowing multiple pallet assemblies 70' to be stacked on one another.

Thereafter, shrink wrap or other types of film, along with a number of plastic bands or straps, may be utilized to secure the pallet assembly 70' during shipment thereof. However, once the pallet assembly 70' has arrived at the retail site, the shrink wrap and the plastic bands are removed in order for the lid 108 to be likewise removed so as to expose the products (e.g. the hose sections 72) within the inside portion 96 of each of the product receptacles 102.

Moreover, as a single stack of the hose sections 72 is removed from the pallet assembly 70', the next product receptacle 102 may be slid forward. In particular, during display of the hose sections 72, as a product receptacle 102 is emptied by, for example, sale of all of the hose sections 72 therein, the product receptacle 102 is removed from atop the inclined surface 100 of the base 98 thereby causing the remaining product receptacles 102 to slide forward along the inclined surface 100. It should be appreciated that such gravity feeding of the product receptacles 102 eliminates the need for a retailer to expend labor to front the product (e.g. the hose sections 72) within the pallet assembly 70'.

In particular regard to the product storage and display assembly 120 of FIGS. 19–21, the assembly may be utilized to display a bulk product such as spray nozzles 122 or washers 124 at a retail site while also providing a convenient, easily-accessible location for the storage of back stock. In particular, as shown in FIG. 19, the product bins 142 may initially be filled with the spray nozzles 122 or the rubber washers 124. Any remaining stock of the bulk products (i.e. "back stock" or, in other words, bulk products leftover from filling of the product bins 142) are stored in the boxes 138 which are generally the boxes in which the bulk products are shipped to the retail site. The back stock boxes 138 are stored on the storage rack 140 of the rack assembly 128.

In this manner, when the rack assembly 128 is positioned in its retracted rack position (as shown in FIGS. 19 and 20), the back stock boxes 138 are neatly tucked within the perimeter of the shelf assembly 130. However, when the product bins 142 are in need of refilling, the rack assembly 128 may be advanced to its extended rack position (as shown in FIG. 21) in order to allow access to the back stock boxes 138 by retail personnel.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

There are a plurality of advantages of the present invention arising from the various features of the retail assemblies described herein. It will be noted that alternative embodiments of the retail assemblies of the present invention may not include all of the features described yet still benefit from at least some of the advantages of such features. Those of ordinary skill in the art may readily devise their own implementations of a retail assembly that incorporate one or more of the features of the present invention and fall within the spirit and scope of the present invention as defined by the appended claims.

What is claimed is:

1. A retail apparatus for storing and displaying a product, comprising:

a base member; and a rack assembly movably secured to said base member, wherein (i) said rack assembly has a product bin and a storage rack, (ii) said storage rack is substantially horizontally disposed, and (iii) said product bin is positioned at an inclined orientation relative to said storage rack, wherein said rack assembly further has a number of rollers which contact said base member during movement of said rack assembly relative to said base member.

2. A retail apparatus for storing and displaying a product, comprising:

a base member; and a rack assembly movably secured to said base member, wherein (i) said rack assembly has a product bin and a storage rack, (ii) said storage rack is substantially horizontally disposed, and (iii) said product bin is positioned at an inclined orientation relative to said storage rack, wherein said rack assembly has a number of rollers rotatably secured thereto, wherein said base member has a roller surface associated therewith, and wherein said number of rollers are positioned in contact with said roller surface so as to allow said rack assembly to roll relative to said base member.

3. The apparatus of claim 2, wherein:

said base member has a stop member secured thereto, said rack assembly is positionable in an extended rack position and a retracted rack position, a first roller of said number of rollers contacts said stop member when said rack assembly is positioned in said extended rack position, and a second roller of said number of rollers contacts said stop member when said rack assembly is positioned in said retracted rack position.

4. A retail apparatus for storing and displaying a product, comprising:

a base member;

a rack assembly movably secured to said base member, wherein (i) said rack assembly has a product bin and a storage rack, (ii) said storage rack is substantially horizontally disposed, and (iii) said product bin is positioned at an inclined orientation relative to said storage rack; and a shelf mounting bracket for securing said retail apparatus to a retail shelf.

5. The apparatus of claim 4, wherein said shelf mounting bracket is secured to said base member.

6. The apparatus of claim 1, further comprising a retainer secured to said base member, wherein said retainer engages said rack assembly so as to movably secure said rack assembly to said base member.

7. A method of storing and displaying a number of products, comprising the steps of:

providing a substantially horizontally disposed base member;

movably securing a rack assembly to said base member, said rack assembly having a product bin and a storage rack, wherein (i) said storage rack is substantially horizontally disposed, and (ii) said product bin is positioned at an inclined orientation relative to said storage rack;

positioning a first plurality of said number of products in said product bin; and storing a second plurality of said number of products in a container positioned on said storage rack.

8. The method of claim 7, wherein:

said rack assembly has a number of rollers rotatably secured thereto, said base member has a roller surface associated therewith, and said movably securing step includes the step of positioning said number of rollers in contact with said roller surface so as to allow said rack assembly to roll relative to said base member.

9. The method of claim 8, wherein (i) said base member has a stop member secured thereto, and (ii) said storage rack is positionable in an extended rack position and a retracted rack position, further comprising the steps of:

advancing said rack assembly such that a first roller of said number of rollers contacts said stop member so as to position said storage rack in said extended rack position during a first period of time, and advancing said rack assembly such that a second roller of said number of rollers contacts said stop member so as to position said rack assembly in said retracted rack position during a second period of time.

10. The method of claim 7, further comprising the step of securing said base member to a retail shelf prior to both said positioning step and said storing step.

11. The method of claim 10, wherein:

said base member has a shelf mounting bracket secured thereto, and said securing step includes the step of securing said shelf mounting bracket to said retail shelf.

12. The method of claim 7, wherein:

said base member has a retainer secured thereto, said movably securing step includes the step of engaging said rack assembly with said retainer so as to movably secure said rack assembly to said base member.

13. A retail apparatus for storing and displaying a product, comprising:

a base member having a roller surface associated therewith; and a rack assembly having a number of rollers rotatably secured thereto, wherein (i) said rack assembly has a product bin and a storage rack, (ii) said storage rack is substantially horizontally disposed, (iii) said product bin is positioned at an inclined orientation relative to said storage rack, and (iv) said number of rollers are positioned in contact with said roller surface so as to allow said rack assembly to roll relative to said base member.

14. The apparatus of claim 13, further comprising a shelf mounting bracket for securing said retail apparatus to a retail shelf.

15. The apparatus of claim 14, wherein said shelf mounting bracket is secured to said base member.

16. The apparatus of claim 13, further comprising a retainer secured to said base member, wherein said retainer engages said rack assembly so as to movably secure said rack assembly to said base member.

17. The apparatus of claim 16, wherein:

said base member has a stop member secured thereto, said rack assembly is positionable in an extended rack position and a retracted rack position, a first roller of said number of rollers contacts said stop member when said rack assembly is positioned in said extended rack position, and a second roller of said number of rollers contacts said stop member when said rack assembly is positioned in said retracted rack position.

* * * * *